US008998275B2

(12) United States Patent
Donaldson et al.

(10) Patent No.: US 8,998,275 B2
(45) Date of Patent: Apr. 7, 2015

(54) UNITARY LATCH, BLAST LOCK, AND RELEASE HANDLE ASSEMBLY FOR VEHICLE DOOR

(75) Inventors: Robert W. Donaldson, Eureka, MO (US); Brandon L. Hemann, New Hampton, IA (US)

(73) Assignee: Trimark Corporation, New Hampton, IA (US)

( * ) Notice: Subject to any disclaimer, the term of this patent is extended or adjusted under 35 U.S.C. 154(b) by 1642 days.

(21) Appl. No.: 12/108,767

(22) Filed: Apr. 24, 2008

(65) Prior Publication Data

US 2009/0267354 A1 Oct. 29, 2009

(51) Int. Cl.

| | |
|---|---|
| ***E05C 3/06*** | (2006.01) |
| ***E05B 53/00*** | (2006.01) |
| ***E05B 63/00*** | (2006.01) |
| ***E05B 85/12*** | (2014.01) |
| ***F41H 5/22*** | (2006.01) |
| *E05B 3/00* | (2006.01) |

(52) U.S. Cl.

CPC ..... *E05B 53/00* (2013.01); *E05B 63/0004* (2013.01); *E05B 85/12* (2013.01); *F41H 5/226* (2013.01); *E05B 83/01* (2013.01)

(58) Field of Classification Search

USPC ..... 292/198, 200, 201, 216, 336.3, DIG. 23, 292/DIG. 53, 1, 44–55, 346, DIG. 54, 137, 292/163, DIG. 21

See application file for complete search history.

(56) References Cited

U.S. PATENT DOCUMENTS

| | | | | | |
|---|---|---|---|---|---|
| 197,115 | A | * | 11/1877 | Frees | 292/28 |
| 2,169,692 | A | * | 8/1939 | Hansen | 292/5 |
| 3,333,878 | A | * | 8/1967 | Pelcin | 292/37 |
| 3,413,025 | A | * | 11/1968 | Sperry | 292/111 |
| 3,612,588 | A | * | 10/1971 | Roppo et al. | 292/1 |
| 3,666,308 | A | * | 5/1972 | Bonnaud | 292/336.3 |
| 3,851,905 | A | * | 12/1974 | Klebba | 292/11 |
| 3,953,061 | A | * | 4/1976 | Hansen et al. | 292/5 |
| 4,505,500 | A | * | 3/1985 | Utsumi et al. | 292/48 |
| 4,641,865 | A | | 2/1987 | Pastva | |
| 4,714,282 | A | | 12/1987 | Henderson | |
| 5,000,495 | A | * | 3/1991 | Wolfgang et al. | 292/216 |
| 5,007,668 | A | * | 4/1991 | Di Giusto | 292/216 |
| 5,117,665 | A | * | 6/1992 | Swan et al. | 70/264 |
| 5,234,237 | A | * | 8/1993 | Gergoe et al. | 292/201 |
| 5,417,470 | A | * | 5/1995 | Holt | 296/187.12 |
| 5,595,076 | A | * | 1/1997 | Weinerman et al. | 70/208 |
| 5,663,520 | A | | 9/1997 | Ladika et al. | |
| 5,749,611 | A | * | 5/1998 | Watson et al. | 292/336.3 |
| 5,802,770 | A | * | 9/1998 | Kavanagh et al. | 49/506 |
| 5,878,532 | A | * | 3/1999 | Kavanagh et al. | 49/380 |

(Continued)

*Primary Examiner* — Carlos Lugo

(74) *Attorney, Agent, or Firm* — McKee, Voorhees & Sease

(57) ABSTRACT

An assembly is provided for opening a heavy weight door, such as on a military vehicle, by an occupant in the vehicle. The assembly includes a latch module with a catch and rotor adapted to engage and disengage the striker on the door frame, a blast lock module including a pawl adapted to engage and disengage the door frame, and a release handle module with a single interior handle for controlling the engagement and disengagement of the latch and blast lock modules. The three modules are pre-assembled on a carrier plate so as to form a rigid, unitary assembly for mounting on the inside of the door. When a person chooses to exit the vehicle, the handle is actuated so as to retract the blast lock and then release the latch. When the door is closed, a person inside the vehicle can actuate the handle so as to engage the blast lock for safety.

7 Claims, 12 Drawing Sheets

(56) References Cited

U.S. PATENT DOCUMENTS

| | | | | |
|---|---|---|---|---|
| 5,893,593 | A * | 4/1999 | Dowling | 292/336.3 |
| 6,101,853 | A * | 8/2000 | Herr | 70/109 |
| 6,363,830 | B1 | 4/2002 | Gonzalez | |
| 6,427,500 | B1 * | 8/2002 | Weinerman et al. | 70/135 |
| 6,493,919 | B2 * | 12/2002 | Morrison et al. | 29/434 |
| 6,722,714 | B2 * | 4/2004 | Ooe et al. | 292/216 |
| 6,733,052 | B2 * | 5/2004 | Perkins et al. | 292/201 |
| 6,823,628 | B2 * | 11/2004 | Morrison et al. | 49/502 |
| 6,902,213 | B2 * | 6/2005 | Lee | 292/216 |
| 7,019,606 | B2 * | 3/2006 | Williams et al. | 335/20 |
| 7,097,216 | B2 | 8/2006 | Lane et al. | |
| 7,111,879 | B2 | 9/2006 | Zweibohmer et al. | |
| 7,198,308 | B2 | 4/2007 | Lane et al. | |
| 7,243,961 | B2 * | 7/2007 | Fukunaga et al. | 292/216 |
| 7,261,328 | B2 * | 8/2007 | Minix | 292/28 |
| 8,465,062 | B2 * | 6/2013 | Weinerman et al. | 292/137 |
| 2007/0262591 | A1 * | 11/2007 | Wright et al. | 292/216 |

* cited by examiner

UNITARY LATCH, BLAST LOCK, AND RELEASE HANDLE ASSEMBLY FOR VEHICLE DOOR

FIELD OF THE INVENTION

The present invention relates to an integrated or unitary assembly for a heavy duty door, such as on military armored vehicles or heavy duty off-road vehicles. The assembly function is for latching and unlatching a primary latch on the door and for engaging and disengaging a rotary pawl blast lock on the door.

BACKGROUND OF THE INVENTION

Standard consumer automobiles and trucks have doors which typical weigh 50-60 pounds. Heavy duty vehicles, such as armored military vehicles, have doors which can weigh in excess of 1000 pounds. Conventional door locks and latches for automobiles, utility vehicles and other specialty vehicles will not stand up to the rigors required of such heavy duty vehicles, such as repeated cycles, vibration, dust and dirt, extreme temperatures, arms fire and bomb blasts.

Manufacturers of heavy duty vehicles, including armored military vehicles and other off-road vehicles, currently purchase separate components for the closing, latching and locking of a vehicle door. For example, separately purchased components may include an inside door release, a locking logic assembly, interconnecting control rods, a rotary pawl blast lock, and an interface for an exterior door handle. The blast lock is a secondary latch which is placed to resist extreme blast forces, as well as substantial forces resulting from such a blast which may lift the vehicle partially off the ground or cause the vehicle to roll. The blast lock enhances door security and personal safety. Normally, the door latch and blast lock mechanisms have separate and independent disengagement controls. All of these components are assembled separately onto the door using 30-36 fasteners, and then interconnected to one another. Significant positioning adjustment is usually necessary for proper functioning of the components. Such individual installation of the various components is time consuming and costly, and thus undesirable from a manufacturing perspective.

Therefore, a primary objective of the present invention is the provision of an improved heavy duty vehicle door latch, rotary pawl blast lock and release handle assembly.

Another objective of the present invention is the provision of a latch, rotary pawl blast lock and release handle assembly which is preassembled as a singular modular unit for subsequent assembly onto the door of a heavy duty vehicle.

A further objective of the present invention is the provision of a unitary or integrated latch, rotary pawl blast lock and release handle assembly which can be quickly and easily installed on a heavy duty vehicle door.

Still another objective of the present invention is the provision of a latch module, a rotary pawl blast lock module and a release handle module which are preassembled and then interconnected before installation of the assembly on a heavy duty vehicle door.

Yet another objective of the present invention is the provision of a heavy duty door latch and lock assembly having multiple modules interconnected to form a single, rigid unit for quick and easy installation onto the door.

Still another objective of the present invention is the provision of a heavy duty door latch and blast rotary pawl lock assembly which is mounted to the door using a total of 10-12 fasteners.

Another objective of the present invention is the provision of a heavy duty vehicle door latch and rotary pawl blast lock assembly which prohibits inadvertent door opening.

A further objective of the present invention is the provision of a latch and rotary pawl blast lock assembly for a heavy duty vehicle door which can be quickly opened from inside the vehicle with a single actuation step, whether the door is locked or unlocked.

A further objective of the present invention is the provision of a heavy duty vehicle door latch and rotary pawl blast lock assembly having a release handle which overrides a lock lever from inside the vehicle.

Still another objective of the present invention is the provision of a heavy duty vehicle door latch and rotary pawl blast lock assembly having a modular design to allow for application to multiple door layouts and arrangements.

Another objective of the present invention is the provision of a heavy duty vehicle door latch and rotary pawl blast lock assembly which replaces conventional, complex latch-logic locking mechanisms with a simple locking rod to disallow movement of the latch rotor.

A further objective of the present invention is a latch and rotary pawl blast lock integrated unit which can be surfaced mounted on the inside of a flat door of a heavy duty vehicle.

Yet another objective of the present invention is the provision of an improved heavy duty vehicle door latch and rotary pawl blast lock assembly for use on armored military vehicles which is durable in use.

These and other objectives will become apparent from the following description of the invention.

BRIEF SUMMARY OF THE INVENTION

The invention is directed towards a unitary assembly for door latching/unlatching and rotary pawl blast lock engagement/disengagement for an occupant door of a heavy duty armored military vehicle or other off-road vehicle. The assembly has multiple modules carried on a single plate to facilitate installation into the vehicle and reduce purchasing complexity.

The individual components of the assembly are contained in one integrated assembly with a single actuation lever for controlling the primary door latch and the blast lock mechanism. This integrated or unitary assembly allows the vehicle manufacturer to fasten the entire assembly to the door using only ten-twelve fasteners, with only minimal position adjustment required to adjust for a particular door configuration or variation. The assembly significantly reduces the vehicle manufacturer's assembly time and part SKU's, which otherwise requires supply chain management.

The system or assembly contains three major functional modules that are pre-assembled and attached to a single carrier plate. The latch module includes a latch, and latch-release trip levers for the interior and exterior door handles. The blast lock module or assembly is a rotary pawl and may be used in multiples. The interior release handle module includes the inside latch release lever or handle, and actuation cams. Control rods or cables interconnect the release handle cams to one of the latch trip levers and to the blast lock pawl. A control rod or cable also interconnects the other latch trip lever to the exterior door handle. The positioning of each of the functional modules can be varied to fit individual vehicle requirements through custom configuration of the module mounting locations on the carrier plate, varying the lengths of the control rods or cables interconnecting the modules, and modifying the design of the control rod or cable actuation cams on the handle module.

This one piece assembly provides several advantages over the conventional multi-part heavy duty vehicle door latches and blast locks. First, the single rigid assembly replaces up to seven separate components, thereby significantly reducing the manufacturer's assembly labor, part ordering, and inventory complexity. Also, the modular design allows for application of modular door layouts and arrangements with minimal custom engineering. The blast lock(s) and the primary latch are opened by a vehicle occupant using the single interior release handle. The assembly also allows a person to open the door using the exterior door handle, which is also connected to the assembly. Furthermore, the interior release handle actuation motion directly interfaces with the rotary pawl blast lock release module to automatically unlock the blast lock latch before the primary lock latch is unlocked when a vehicle occupant attempts to open the door using the interior release handle.

DETAILED DESCRIPTION OF THE PREFERRED EMBODIMENT

Figure 1A:
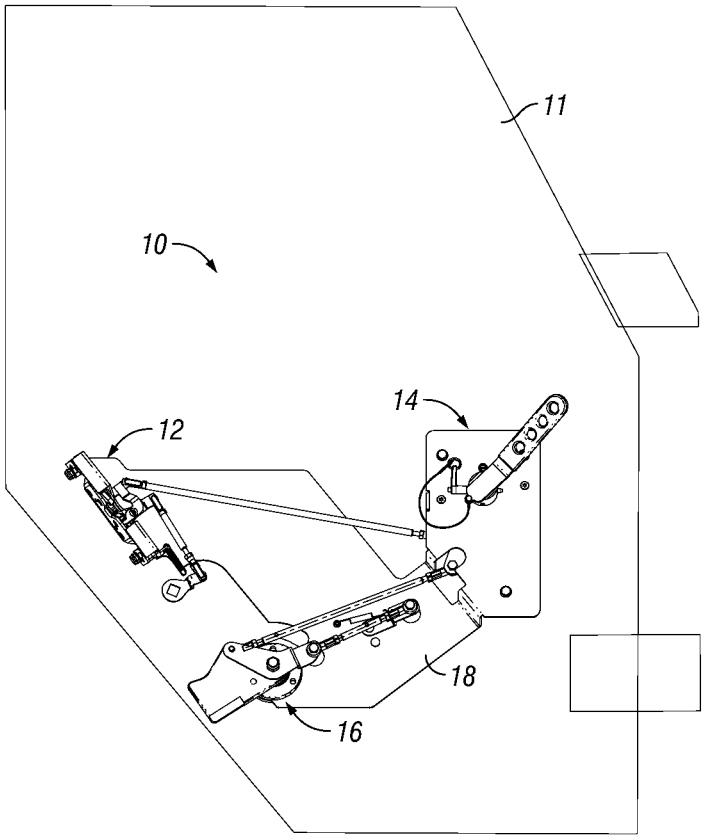
FIG. 1A is an inside elevation view showing the assembly of the present invention installed on a heavy duty military vehicle door.
Figure 1B:
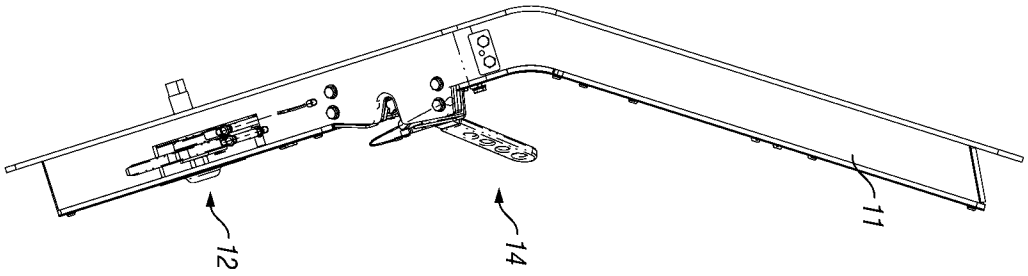
FIG. 1B is a side elevation view of the door of FIG. 1A.

The assembly of the present invention is generally designated in the drawings by the reference numeral 10. The assembly includes a latch module 12, a release handle module 14, and a blast lock module 16. The modules are mounted on a carrier plate 18 so as to be interconnected to form a single, rigid, integrated unit which is pre-assembled before mounting the unit to the inside of a heavy weight or heavy duty door 11, such as an armored door of a military vehicle. The door 11 is mounted in a door frame (not shown) by hinges for movement between open and closed positions. The door 11 includes an exterior L handle (not shown).

Module Components

The latch module 12 includes a housing 20 which pivotally supports a catch 22 and a rotor 24. The catch and rotor 24 are pivotal between open and closed positions, but are biased to the open position by springs 52, 54 within the housing 20. The rotor 24 is adapted to engage and disengage a striker bolt (not shown) on the door frame, such that the door 11 is moveable between a latched closed position and an unlatched open position. The latch module 12 also includes mounting blocks 26 each of which is adapted to receive a screw or bolt 28 for mounting the latch module 12 to the carrier plate 18.

The latch housing 20 includes a tab 30 which pivotally supports first and second arms or levers 32, 34 via a rivet 36, best seen in FIGS. 12-15. The first lever 32 includes a finger 38 adapted to engage the catch 22. The outer end 40 of the first lever 32 is operatively connected to an arm 42 of the exterior door handle (not shown) via a rod 44. The arm 42 has a square hole 46 so that the arm is mounted on the axle of the exterior door handle. Thus, upon actuation of the exterior door handle, the arm 42 is rotated downwardly such that the rod 44 pulls the end 40 of the lever 32 so as to pivot the lever 32 about the rivet 36, thereby rotating the catch 22 about its axis 48 under the bias of its spring 52. Such rotation of the catch 22 disengages the catch from the rotor 24, which pivots about its axis 50 under the bias of its spring 54, thereby disengaging the striker on the door frame so that the door 11 is free to open. The arm 42 is biased to an upward or neutral position by a spring 56.

The release handle module 14 includes an axle 62 extending through the carrier plate 18. The inner and outer ends 64, 66 of the axle 62 are preferably square or other shape so as to rotate components mounted thereon.

The handle module 14 also includes an elongated handle 68 having a hub 70 mounted on the inner end 64 of the axle 62. The hub 70 is secured to the axle 62 by a pin 71 extending through aligned holes in the hub 70 and the inner end 64 of the axle 62. A cord or cable 73 attaches the pin 71 to the handle 68 so as to preclude the pin 71 from being lost when it is removed from the hub 70.

Figure 8:
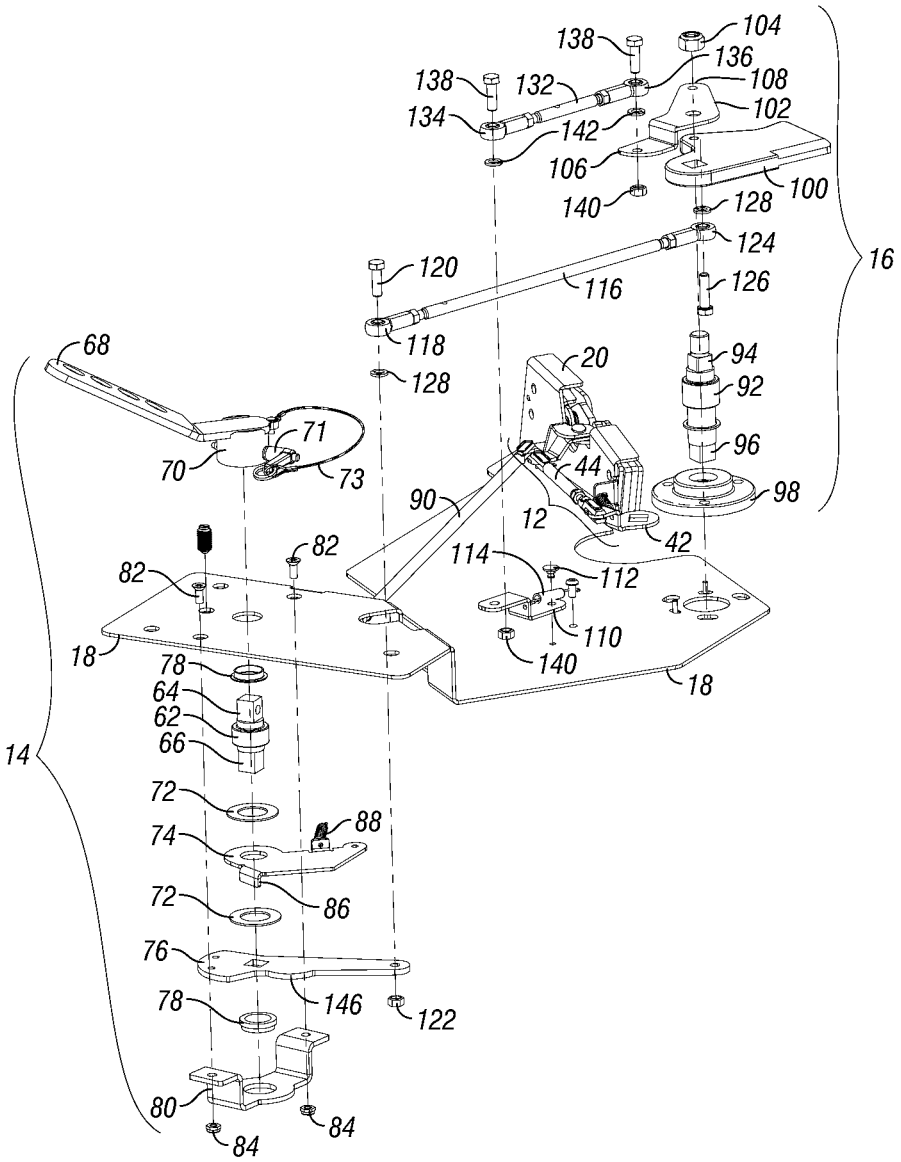
FIG. 8 is a front partially exploded view of the assembly.
Figure 9:
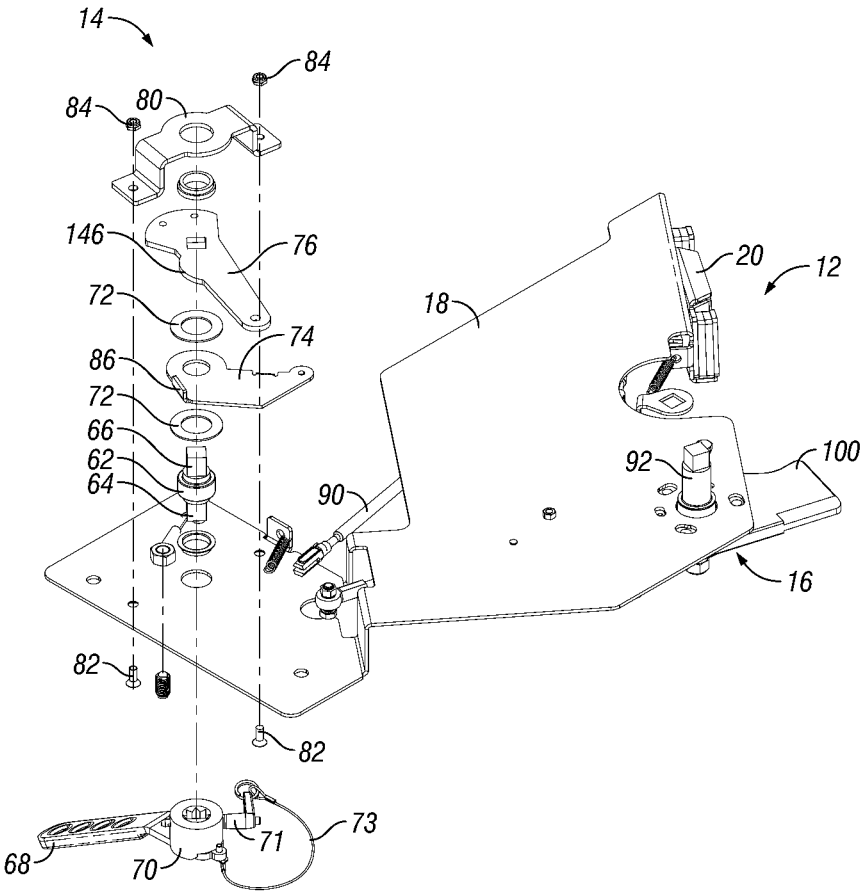
FIG. 9 is a rear partially exploded view of the assembly.
Figure 10:
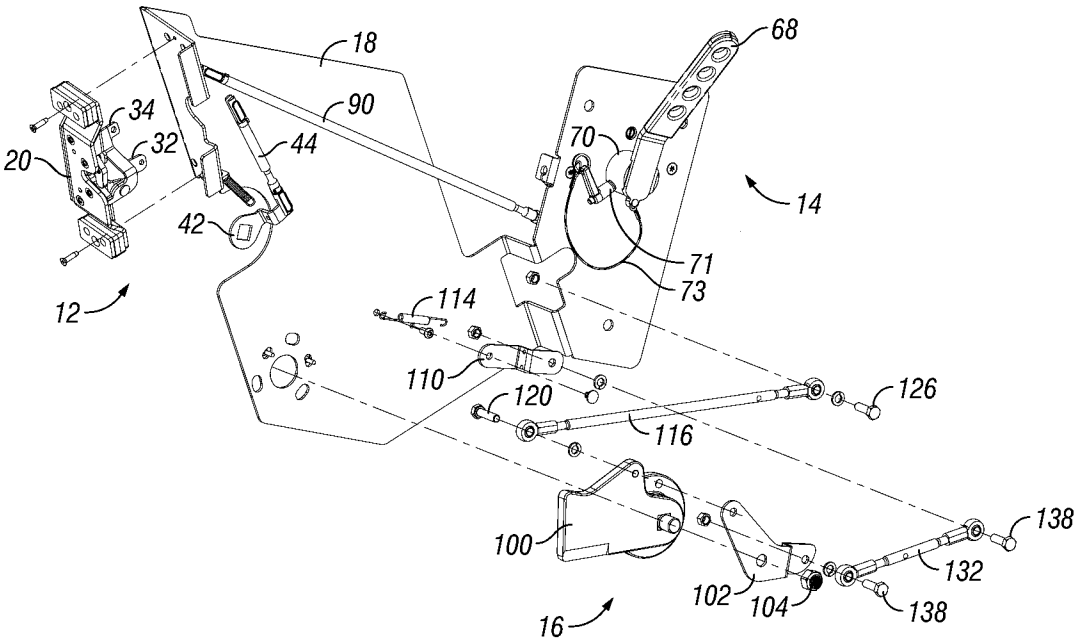
FIG. 10 is another front partially exploded view of the assembly.
Figure 11:
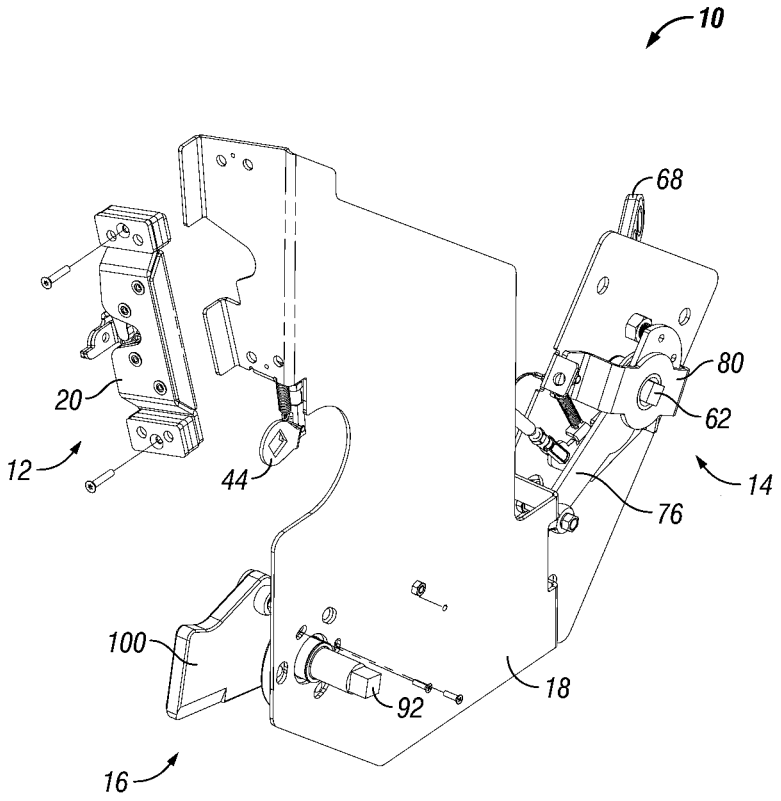
FIG. 11 is another rear partially exploded view of the assembly.
Figure 12:
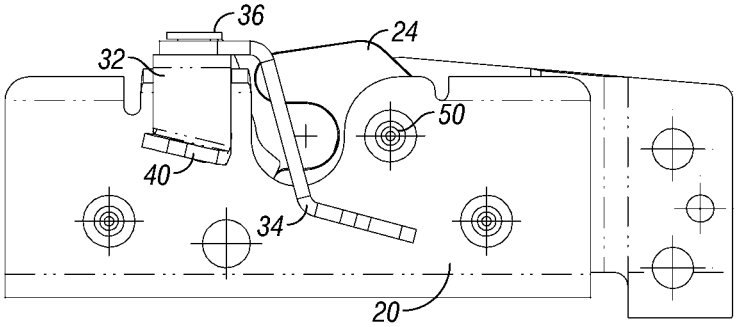
FIG. 12 is an elevation view of the latch assembly.
Figure 13:
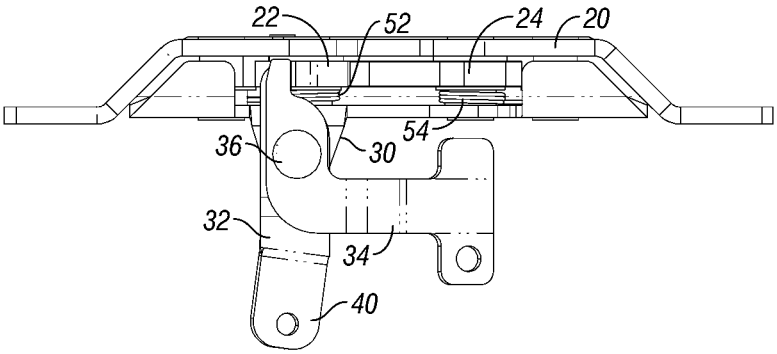
FIG. 13 is a top plan view of the latch assembly.
Figure 14:
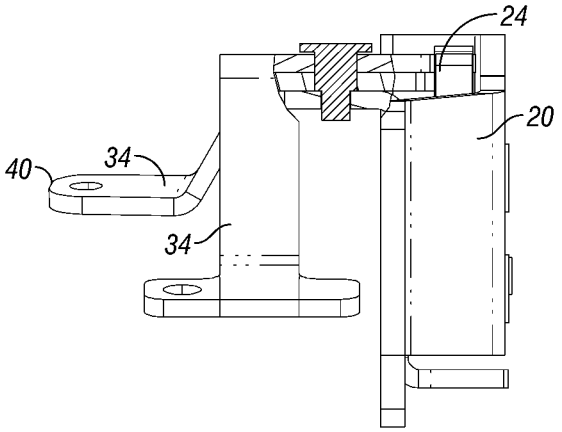
FIG. 14 is an end elevation view of the latch assembly.
Figure 15:
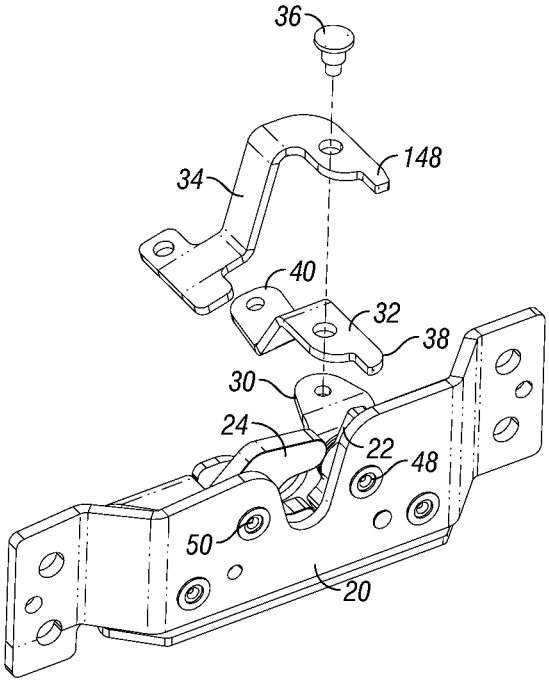
FIG. 15 is a partially exploded view of the latch assembly.

On the outer end 66 of the axle 62 is mounted a washer 72, a plate 74, another washer 72, a lever 76, a bushing 78, and a U-shaped bracket 80, as best seen in FIG. 8. The bracket 80 is mounted to the carrier plate 18 using a pair of bolts 82 and nuts 84. The plate 74 is rotatably mounted on the axle 62 and includes an outwardly extending tab 86 and a spring 88, which biases the handle 68 to a nautical position from an unlock position. The ends of the spring 88 are connected to the tab 86 and to the plate 74. The lever 76 is mounted for rotation with the axle 62 via a square hole for receiving the square end of the axle 62. Another bushing 78 is provided on the inner end 64 of the axle 62. A connecting rod 90 interconnects the handle module 14 on latch module 12. The rod 90 extends between the lever 76 of the handle module 14 and the second arm 34 of the latch module 12.

The blast lock module 16 includes an axle 92 which rotatably extends through the carrier plate 18 and includes opposite inner and outer ends 94, 96. The inner and outer ends 94, 96 of the axle 92 include square or flat-sided portions so as to rotate components mounted thereto.

A cap 98 is mounted to the interior face of the carrier plate 18 and defines a bearing for the axle 92. A blast lock pawl 100 includes a square hole for mounting onto the inner end 94 of the axle 92 for rotation therewith. A cam 102 also mounts onto the axle 92 on top of the blast lock pawl 100 for rotation about the axle 92. A nut 104 secures the pawl 100 and cam 102 onto the axle 92. The cam 102 includes opposite ends 106, 108.

Another cam 110 is pivotally mounted onto the carrier plate 18 between the blast lock pawl 100 and the handle 68 via rivet 112. A spring 114 has opposite ends connected to the plate 18 and to the cam 110 to bias the cam 110 to a first position.

A connecting rod 116 interconnects the handle module 14 and the blast lock module 16. The first end 118 of the connecting rod 116 is connected to an end of the lever 76 of the handle module 14 with a bolt 120 and nut 122. The second end 124 of the rod 116 is connected to the pawl 100 and to the cam 102 of the blast lock module 16 via a bolt or screw 126. A washer 128 is provided between the second end 124 of the rod 116 and the pawl 100.

Another connecting rod 132 has a first end 134 connected to the free end of the cam 110 and a second end 136 connected to the opposite end of the cam 102 of the blast lock module 16. Bolts 138 and nuts 140 secure the ends 134, 136 of the rod 132 to the respective cams 110, 102. Washers 142 reside between the rod 132 and the cams 110, 102.

The assembly 10 is mounted to the vehicle door 11 using 10-12 fasteners, such as screws or bolts, after the modules 12, 14, 16 are assembled. For example, there are four installation holes 150 in the housing 20 of the latch module 12, three holes 152 in the plate 18 adjacent the handle module 14, and three holes 154 in the plate 18 adjacent the blast lock module 16, to receive the fasteners.

Assembly Operation

Figure 2:
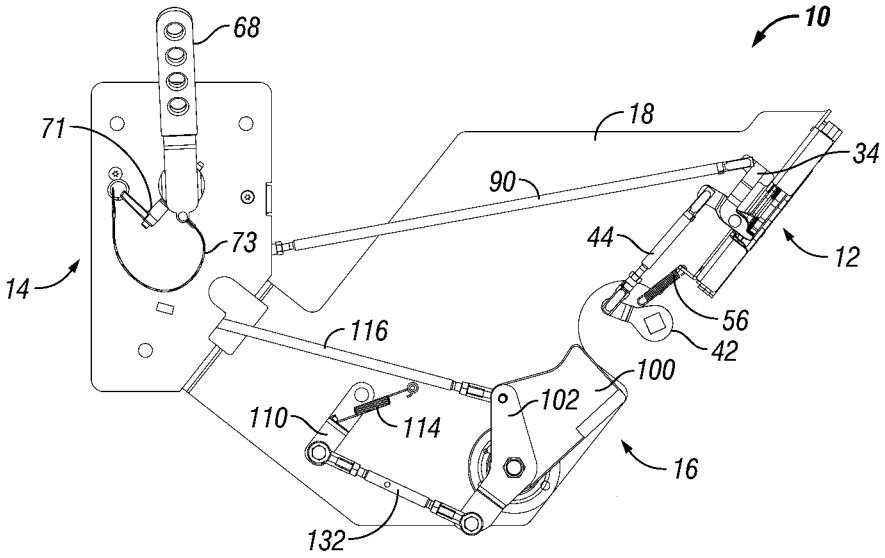
FIG. 2 is an elevation view of the assembly with the rotary pawl blast lock in an unlocked position.

When the vehicle door 11 is moved from an opened position to a closed position within the frame, the handle 68 on the inside of the door needs to be in the unlocked position, such that the blast lock pawl 100 is in the retracted position, as shown in FIG. 2. When the door is closed with the rotor 24 capturing the door frame striker (not shown), the handle 68 can be pushed forwardly to the locked position shown in FIG. 3. As the handle 68 is rotated to the locked position, the rods 116 and 132 pivot the blast lock pawl 100 to the locked position extending beyond the carrier plate 18. The cam 102 facilitates the rotation of the pawl 100 via the connections of the rods 116, 132 to the cam 102, which pivots about the axis of the blast lock axle 92. The pivotal movement of the cam 102 also pivots the cam 110 on the plate 18, as seen in FIGS. 2 and 3.

Figure 3:
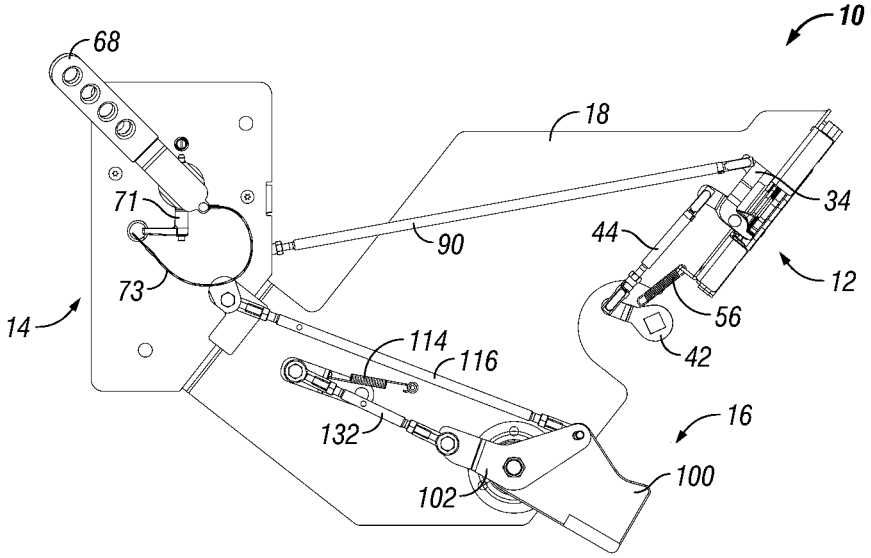
FIG. 3 is an elevation view showing the assembly with the rotary pawl blast lock in a locked position.
Figure 4:
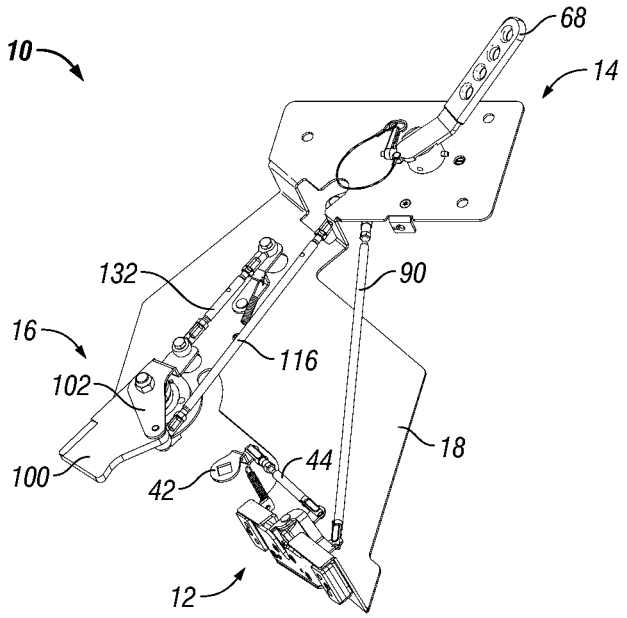
FIG. 4 is a perspective view of the assembly with the rotary pawl blast lock in a locked position.
Figure 5:
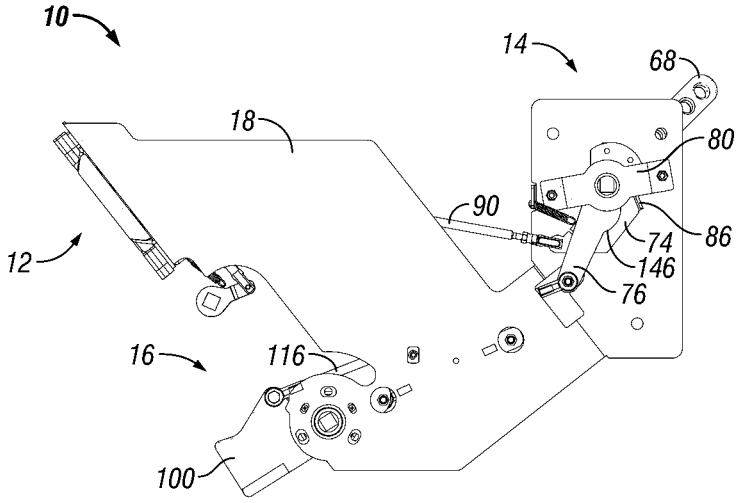
FIG. 5 is a rear elevation view of the assembly with the rotary pawl blast last lock in a locked position.
Figure 6:
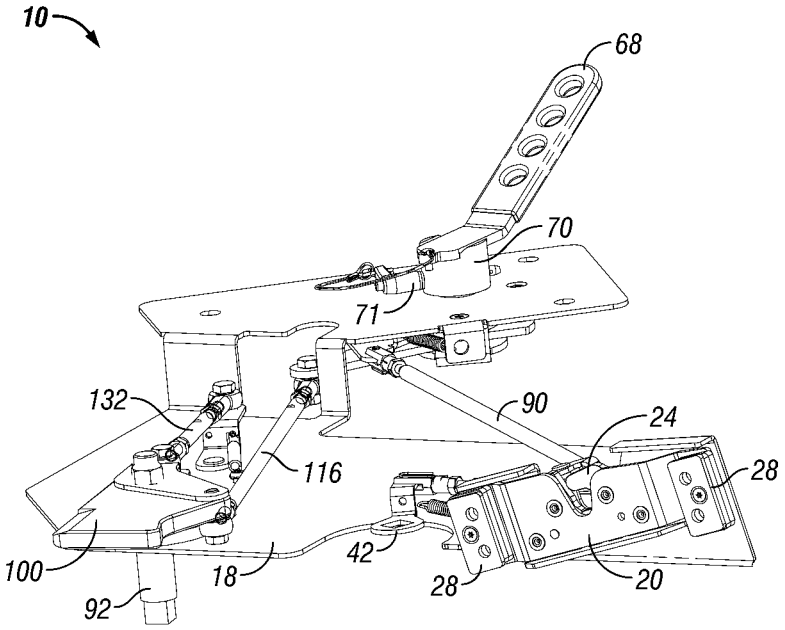
FIG. 6 is another perspective view of the assembly with the rotary pawl blast lock in a locked position.
Figure 7:
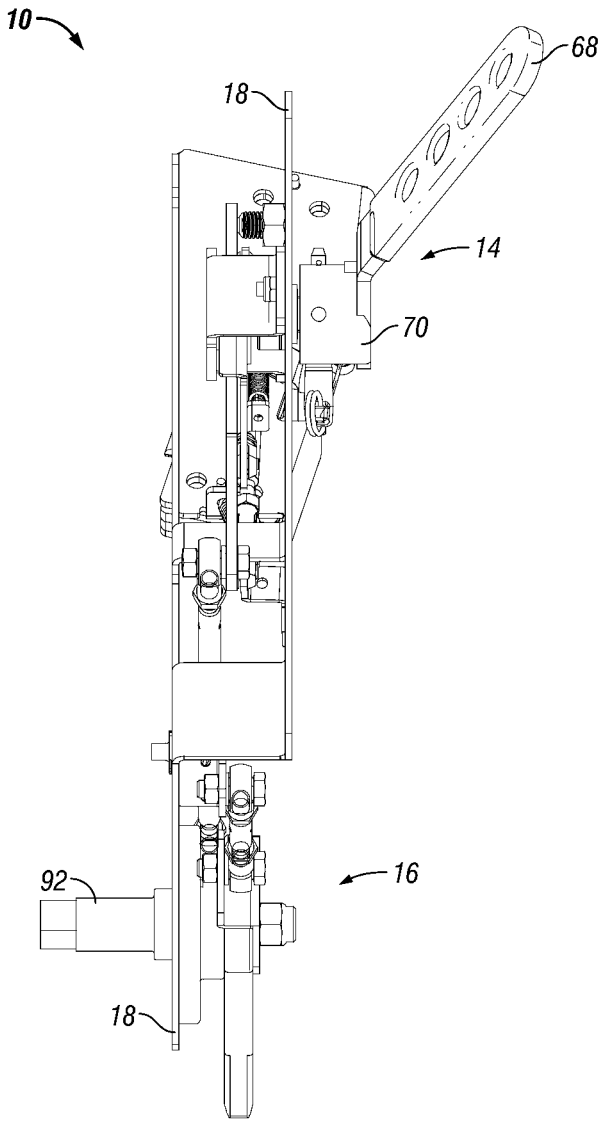
FIG. 7 is end elevation view of the assembly.

When an occupant in the vehicle desires to open the door 11, the handle 68 is pulled rearwardly from the locked position shown in FIG. 3 to the unlocked position shown in FIG. 2. This pivotal movement of the handle 68 first causes the blast lock pawl 100 to be rotated from the extended position shown in FIG. 3 to the retracted position shown in FIG. 2 via the lever 76 which rotates with the handle 68, the connecting rods 116, 132, and the pivotal cams 102, 110. As rotation of the handle 68 continues, a cam surface 146 on the lever 76 engages the tab 86 on the plate 74 of the handle module 14, thereby causing the plate 74 to rotate, which in turn pulls the connecting rod 90, which pivots the second lever 34. A finger 148 on the second lever 34 engages the catch 22 and rotates the catch about its axis 48, thereby releasing the rotor 24 from engagement with the striker. Thus, rotation of the handle 68 from the locked position to the unlocked position sequentially unlocks the blast lock pawl 100 and then the rotor 24, so that the door 11 can be opened from inside the vehicle. When the handle 68 is released by a person in the vehicle, the spring 88 biases the handle 68 back to the neutral position between the lock and unlock positions.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A unitary door latch, lock and handle assembly for opening a vehicle door pivotally mounted in a door frame, the frame including a striker to retain the door in a closed position, the door including an exterior handle, the assembly comprising:

a rotary latch module including a catch and a rotor engaging the striker to maintain the door in a closed position and disengaging the striker to allow the door to pivot open;

a lock module including a lock pawl releasably engaging the door frame to lock the door in a closed position and disengaging the frame to allow the door to pivot open;

a handle module including an interior handle for actuating the disengagement of both the latch module and the lock module and for actuating engagement of the lock module;

a carrier plate to which the latch module, lock module and handle module are rigidly mounted to form a single pre-assembled unit for subsequent installation on the door;

the rotary latch module further including a first lever connected to the exterior handle of the door and a second lever connected to the interior handle of the handle module;

a first rod extending between the latch and handle modules, a second rod extending between the lock and handle modules, and a third rod connecting the latch module to the exterior handle;

wherein pulling the interior handle rearwardly sequentially disengages the lock module and then releases the rotor of the latch module so that the door can then pivot open; and wherein pushing the interior handle forwardly engages the lock module to retain the door in a closed position.

2. The assembly of claim 1 wherein the assembly is mounted to the door using no more than 12 fasteners.

3. The assembly of claim 1 further comprising a first rod extending between the latch and handle modules and a second rod extending between the lock and handle modules.

4. The assembly of claim 1 wherein the lock pawl is moveable between extended and retracted positions relative to the carrier plate.

5. The assembly of claim 4 wherein the movement of the pawl is controlled by the handle module.

6. The assembly of claim 5 wherein the handle module is connected to a pair of cams to sequentially actuate the pawl and then the rotor when the handle module is actuated.

7. The assembly of claim 4 wherein the interior handle is pivotal between lock and unlock positions to move the pawl between extended and retracted positions.

* * * * *